US008196324B2

(12) United States Patent
Sullivan et al.

(10) Patent No.: US 8,196,324 B2
(45) Date of Patent: Jun. 12, 2012

(54) LAYERED IMAGE ASSEMBLY

(75) Inventors: John C. Sullivan, Madison, CT (US); Jeffrey Stanley Samson, Irvine, CA (US); Robert F. Morton, Roscoe, IL (US)

(73) Assignee: Action Wobble Inc., Newport Beach, CA (US)

( * ) Notice: Subject to any disclaimer, the term of this patent is extended or adjusted under 35 U.S.C. 154(b) by 89 days.

(21) Appl. No.: 11/834,898

(22) Filed: Aug. 7, 2007

(65) Prior Publication Data

US 2008/0028646 A1 Feb. 7, 2008

Related U.S. Application Data

(60) Provisional application No. 60/821,690, filed on Aug. 7, 2006.

(51) Int. Cl.
*G09F 3/10* (2006.01)

(52) U.S. Cl. ..... 40/638; 283/105

(58) Field of Classification Search ..... 283/71, 283/98, 100, 105, 903; 273/138.1; 40/630
See application file for complete search history.

(56) References Cited

U.S. PATENT DOCUMENTS

| | | | | |
|---|---|---|---|---|
| 2,254,545 | A * | 9/1941 | Roberts | 206/103 |
| 3,427,642 | A * | 2/1969 | Mohr | 40/124.08 |
| 3,798,806 | A | 3/1974 | Sanford | |
| 4,846,504 | A * | 7/1989 | MacGregor et al. | 283/102 |
| 4,868,027 | A * | 9/1989 | Hunkeler et al. | 428/42.3 |
| 5,238,272 | A | 8/1993 | Taylor | |
| 5,403,636 | A * | 4/1995 | Crum | 428/41.8 |
| 5,423,573 | A | 6/1995 | De Passille | |
| 5,487,566 | A | 1/1996 | Hedge, Jr. | |
| 6,135,507 | A * | 10/2000 | Hamby et al. | 283/81 |
| 6,329,034 | B1 * | 12/2001 | Pendry et al. | 428/40.1 |
| 6,520,542 | B2 | 2/2003 | Thompson et al. | |
| 7,722,431 | B2 | 5/2010 | Sullivan et al. | |
| 2004/0135363 | A1 | 7/2004 | Vanderheiden et al. | |
| 2007/0089334 | A1 | 4/2007 | Sullivan et al. | |

FOREIGN PATENT DOCUMENTS

| | | | |
|---|---|---|---|
| JP | 06-305283 | A | 11/1994 |
| JP | 09-211835 | A | 8/1997 |
| JP | 03073373 | U | 9/2000 |
| JP | 2001-080254 | A | 3/2001 |
| JP | 2002-178677 | A | 6/2002 |
| JP | 2003-061799 | A | 3/2003 |

OTHER PUBLICATIONS

International Search Report and Written Opinion issued Dec. 18, 2007 in corresponding PCT Patent Application No. PCT/US07/75357.

Office action issued Apr. 1, 2011 in corresponding Chinese Patent Application No. 200780036687.2.

Office action issued Jun. 4, 2010 in corresponding Chinese Patent Application No. 200780036687.2.

(Continued)

*Primary Examiner* — Joanne Silbermann
(74) *Attorney, Agent, or Firm* — Pearne & Gordon LLP

(57) ABSTRACT

A layered assembly includes a first adhesive layer and a protective top layer affixed permanently on all sides to the first adhesive layer. The assembly also includes a first image layer onserted between the first adhesive layer and the protective top layer, wherein the protective top layer is provided over the first image layer and at least a portion of the protective top layer can be removed to reveal the first image layer.

37 Claims, 13 Drawing Sheets

OTHER PUBLICATIONS

Examination Report issued Sep. 17, 2010 in corresponding New Zealand Patent Application No. 575347.
Examiner's report issued Oct. 12, 2010 in corresponding Australian Patent Application No. 2007281755.
International Search Report and Written Opinion issued Dec. 24, 2010 in PCT Application No. PCT/US2010/035618.
International Search Report and Written Opinion issued Jan. 4, 2011 in PCT Application No. PCT/US2010/039197.

* cited by examiner

LAYERED IMAGE ASSEMBLY

CROSS REFERENCE TO RELATED APPLICATIONS

This application claims the benefit of U.S. Provisional Patent Application No. 60/821,690, filed on Aug. 7, 2006 and entitled LAYERED IMAGE ASSEMBLY.

BACKGROUND OF THE INVENTION

1) Field of the Invention

The present invention relates to a layered assembly, and more particularly, to an assembly having two or more layers wherein at least one of the layers includes an image.

2) Description of Prior Art

Greeting cards are typically printed with static designs and in large quantities. They can commonly be purchased at card stores such as Hallmark, bookstores and other retail locations. After a user purchases the greeting cards, she can handwrite personalized information on the greeting cards and mail them to family members, friends, or business clients. Card printing vending machines have been developed to allow the card purchasers to select the card designs and input their own personalized messages before the actual cards are printed.

In recent years, online photo services such as Shutterfly, Inc., based at Redwood City, Calif., have established services for users to upload, store and share their digital photo images. The users can order physical photo products such as photographic prints, photo books, CD's, etc. The print orders are fulfilled using automated digital printers, and shipped to the recipients as specified by the user. However, the users typically have to order the photo products in large quantities to save on setup and printing costs. Moreover, the photos are not separable from the products thereby limiting the use of the photo by the recipient of the product.

Also available are PHOTOSTAMPS, which allow users to take their own images or photographs and turn them into real U.S. postage via a service such as Stamps.com®. The users just need to upload a photo, customize it, and place their order. The stamps are then printed by the Stamps.com® company and sent to the user for use. However, when the recipient of the personalized stamp receives a letter, card, or package in the mail with the personalized stamp, the stamp by then has the cancellation mark across the stamp from the post office, thereby defacing the personalized image or photo.

Businesses can also take advantage of using personalized products. Using personalized images allows for many marketing opportunities. For instance, personalized images can be used for logos, product introductions, advertising, special events, corporate gifts, etc.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with an aspect of the present invention, a layered assembly is provided. The layered assembly includes a first adhesive layer and a protective top layer affixed permanently on all sides to the first adhesive layer. The assembly also includes a first image layer onserted between the first adhesive layer and the protective top layer, wherein the protective top layer is provided over the first image layer and at least a portion of the protective top layer can be removed to reveal the first image layer.

In accordance with another aspect of the present invention, a layered assembly is provided. The layered assembly includes: an adhesive layer; at least one image layer; and at least one protective layer, wherein the protective layer is coupled to one of the plurality of image layers such that the protective layer can be removed from the layered assembly without damage to the plurality of image layers.

In accordance with yet another aspect of the present invention, a layered assembly is provided. The assembly includes: a support structure; a base layer coupled to the support structure; at least one image layer coupled to the base layer; and a protective top layer coupled to the at least one image layer.

The following description and the annexed drawings set forth in detail certain illustrative aspects of the invention. These aspects are indicative, however, of but a few of the various ways in which the principles of the invention may be employed and the present invention is intended to include all such aspects and their equivalents. Other objects, advantages and novel features of the invention will become apparent from the following detailed description of the invention when considered in conjunction with the drawings.

BRIEF DESCRIPTION OF THE DRAWINGS

The foregoing and other features and advantages of the present invention will become apparent to those skilled in the art to which the present invention relates upon reading the following description with reference to the accompanying drawings.

FIG. 7A illustrates a component of the layered image assembly of FIG. 7 in accordance with an aspect of the present invention.

FIG. 7B illustrates a component of the layered image assembly of FIG. 7 in accordance with an aspect of the present invention.

FIG. 7C illustrates a component of the layered image assembly of FIG. 7 in accordance with an aspect of the present invention.

DESCRIPTION OF EXAMPLE EMBODIMENTS

Figure 1:
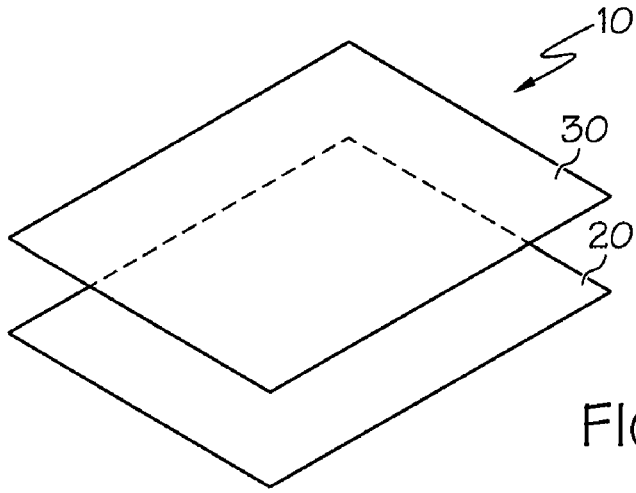
FIG. 1 illustrates a layered image assembly in accordance with an aspect of the present invention.

The present invention relates to an assembly having two or more layers wherein at least one of the layers includes an image thereon, the image can include text, a photograph, a drawing, or any other suitable image and any combination thereof. The present invention will now be described with reference to the drawings, wherein like reference numerals are used to refer to like elements throughout. It is to be appreciated that the various drawings are not drawn to scale from one figure to another nor inside a given figure, and in particular that the size of the components are arbitrarily drawn for facilitating the reading of the drawings. In the following description, for purposes of explanation, numerous specific details are set forth in order to provide a thorough understanding of the present invention. It may be evident, however, that the present invention may be practiced without these specific details.

Referring initially to FIG. 1, an exploded view of a layered image assembly 10 is illustrated. The layered image assembly 10 includes a first layer 20 and a second layer 30 provided over the first layer 20. The first and second layers 20, 30 can be manufactured from any of paper, film, plastic, cardboard, any other suitable material, or from a combination of materials and can be of any suitable shape and size. Further, one or both of the first and second layers 20, 30 can be substantially transparent, semitransparent, opaque, or any combination thereof. It is to be appreciated that the layered assembly can include any desired number of layers and is contemplated as falling within the scope of the present invention. In accordance with one aspect of the present invention, the first layer 20 has one or more images provided thereon and the second layer 30 is a protective layer that covers the image(s) when assembled with the first layer 20. The first layer 20 can have images printed on one or both sides of the layer. The image(s) on the first layer 20 can be visible, partially visible, or hidden when the protective cover is positioned over the image(s). The second layer 30 can also have one or more images provided thereon. Like the first layer 20, the second layer 30 can have images printed on one or both sides of the layer.

Figure 2:
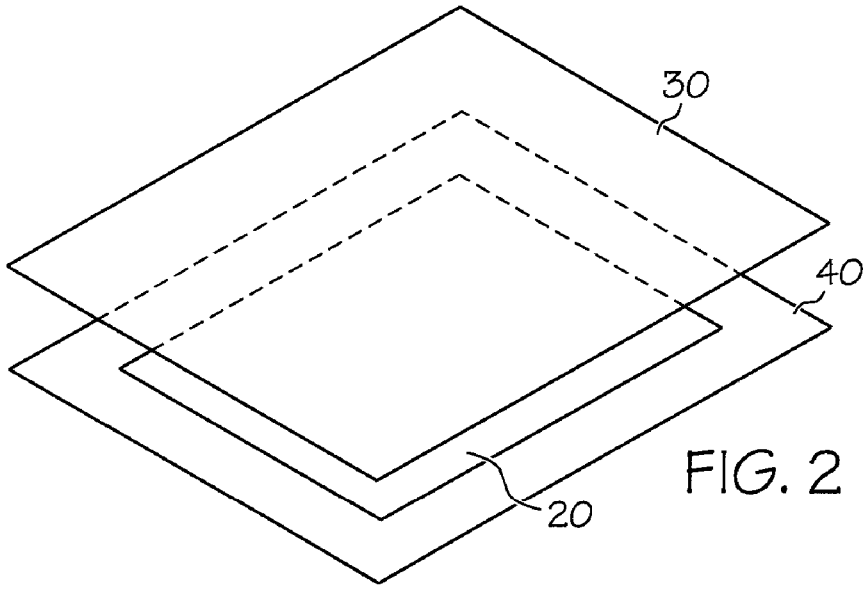
FIG. 2 illustrates the layered image assembly of FIG. 1 with an adhesive layer in accordance with an aspect of the present invention.
Figure 3:
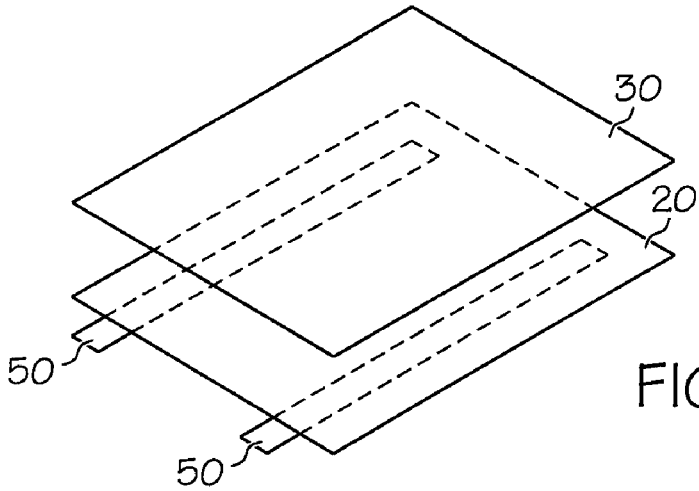
FIG. 3 illustrates the layered image assembly of FIG. 1 with an adhesive layer in accordance with an aspect of the present invention.

The layered assembly 10 can include one or more adhesive layers, as shown in FIGS. 2-6. The adhesive layer can be a permanent adhesive, a removable adhesive, or a repositionable adhesive. As shown in FIGS. 2-3, an adhesive layer 40 can be provided below the first layer 20 and can be of any suitable shape and size. For instance in FIG. 2, the adhesive layer 40 can be a single layer sized larger than the first layer 20 and smaller or of substantially the same size as the second layer 30. Thus, the adhesive layer 40 can function to secure both the first and second layers 20, 30 to a suitable surface. This configuration also allows the second layer 30 to be removed without damage to the first layer 20 regardless of the adhesive used (e.g., permanent, removable, repositionable). As an example, the adhesive layer 40 is attached to the first layer 20 and the second layer 30 is inserted or onserted, as known in manufacturing and marketing, between solid edge frame of the first layer 20.

Alternately, as shown in FIG. 3, a plurality of adhesive portions 50, such as strips, can be used to secure both the first and second layers 20, 30. The adhesive portions 50 can be of a length or width larger than the first layer 20 and smaller or of substantially the same length or width as the second layer 30 so as to function in a manner similar to that described above with respect to FIG. 2.

Figure 4:
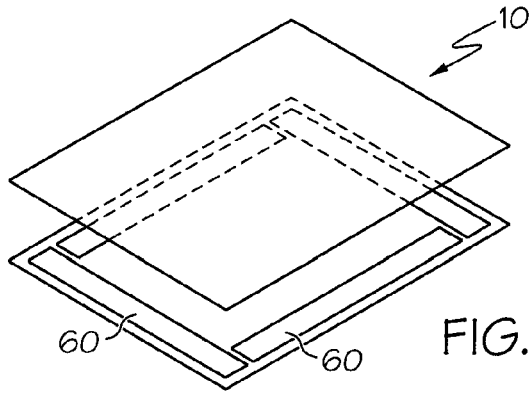
FIG. 4 illustrates the layered image assembly of FIG. 1 with an adhesive layer in accordance with an aspect of the present invention.

In accordance with another example, FIG. 4 illustrates an adhesive layer 60 used to only secure the second layer 30 to a suitable surface. The first layer 20 is of a smaller size than the second layer 30 and the adhesive layer 60 is provided as a single sheet with a cut out portion that corresponds to the size of the first layer 20. Thus, the adhesive layer 60 does not contact the first layer 20. Rather than a single sheet, the adhesive layer 60 can be provided as separable portions positioned to secure only the second layer 30 to a suitable surface. As above, the adhesive does not contact the first layer 20. Thus, the first layer 20 is only secured by being trapped under the second layer 30, which is secured to a suitable surface via the adhesive layer 60. In this example, the adhesive layer 60 can also be any of a permanent, removable, or repositionable adhesive.

Figure 5:
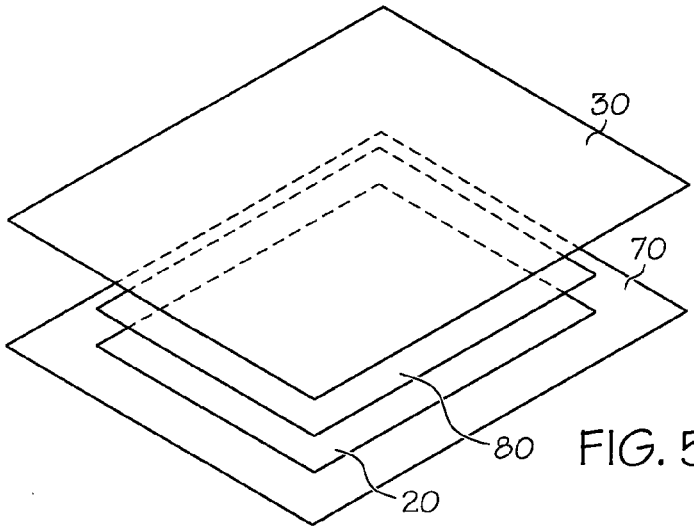
FIG. 5 illustrates the layered image assembly of FIG. 1 with two adhesive layers in accordance with an aspect of the present invention.

In accordance with another example, a layered image assembly can include a plurality of adhesive layers. Turning now to FIG. 5, the layered image assembly 10 can include a first adhesive layer 70 provided below the first layer 20 and a second adhesive layer 80 provided between the first layer 20 and the second layer 30. The first and second adhesive layers 70, 80 can be of any suitable size and shape and can be of any suitable adhesive, including permanent, removable, and repositionable. For instance, the first adhesive layer 70 can be a repositionable layer and the second adhesive layer can be a removable layer. Thus, the second layer 30 can be removed from the first layer 20 without damaging the first layer 20 and the first layer 20 can be removed from a first surface and repositioned on a second surface. Any combination of permanent, removable, and repositionable adhesive layers can be used as long as the second layer 30 can be removed from the first layer 20 without damage to the first layer 20.

Figure 6:
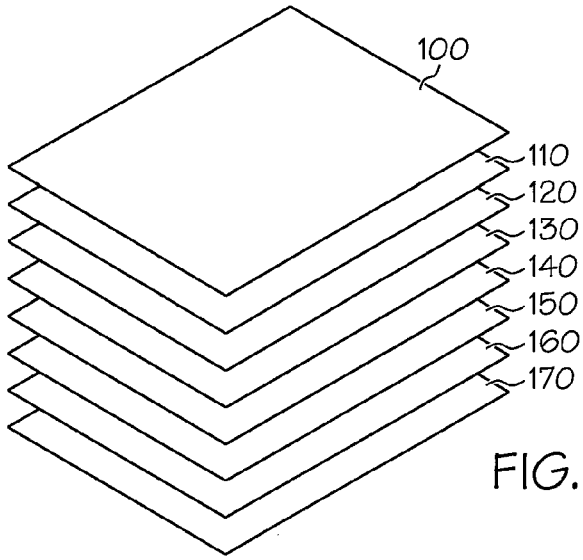
FIG. 6 illustrates a layered image assembly in accordance with an aspect of the present invention.

As shown in FIG. 6, the present invention is not limited to a two-layered assembly. Any imaginable number of image and protective layers having any imaginable shape and size can be employed in accordance with the present invention. Likewise, any suitable number of adhesive layers can be used having any suitable shape, size, and adhesive to secure one or more of the image and protective layers. It is to be further appreciated that the image layer can include any suitable object such as a stamp, a booklet, an advertisement, a brochure, a coupon, a photograph, a drawing, a wobble object, a craft item, a credit card, a greeting card, a z-fold layer, an accordion layer, etc. As an example, in FIG. 6, layer 100 can be a substantially transparent protective layer, layer 110 can be a removable adhesive, layer 120 can be an advertisement that could be seen through the substantially transparent protective layer 100, layer 130 can be an informational brochure about the product being advertised, layer 140 can be a coupon or special offer for the product, layer 150 can be a frequent shopper card for the store or company offering the product, layer 160 can be a product photograph, and layer 170 can be a repositionable adhesive so that the consumer can reattach the product photograph to another desired surface. The informational brochure 130, while not illustrated as such, can be folded in any desired manner.

Figure 7:
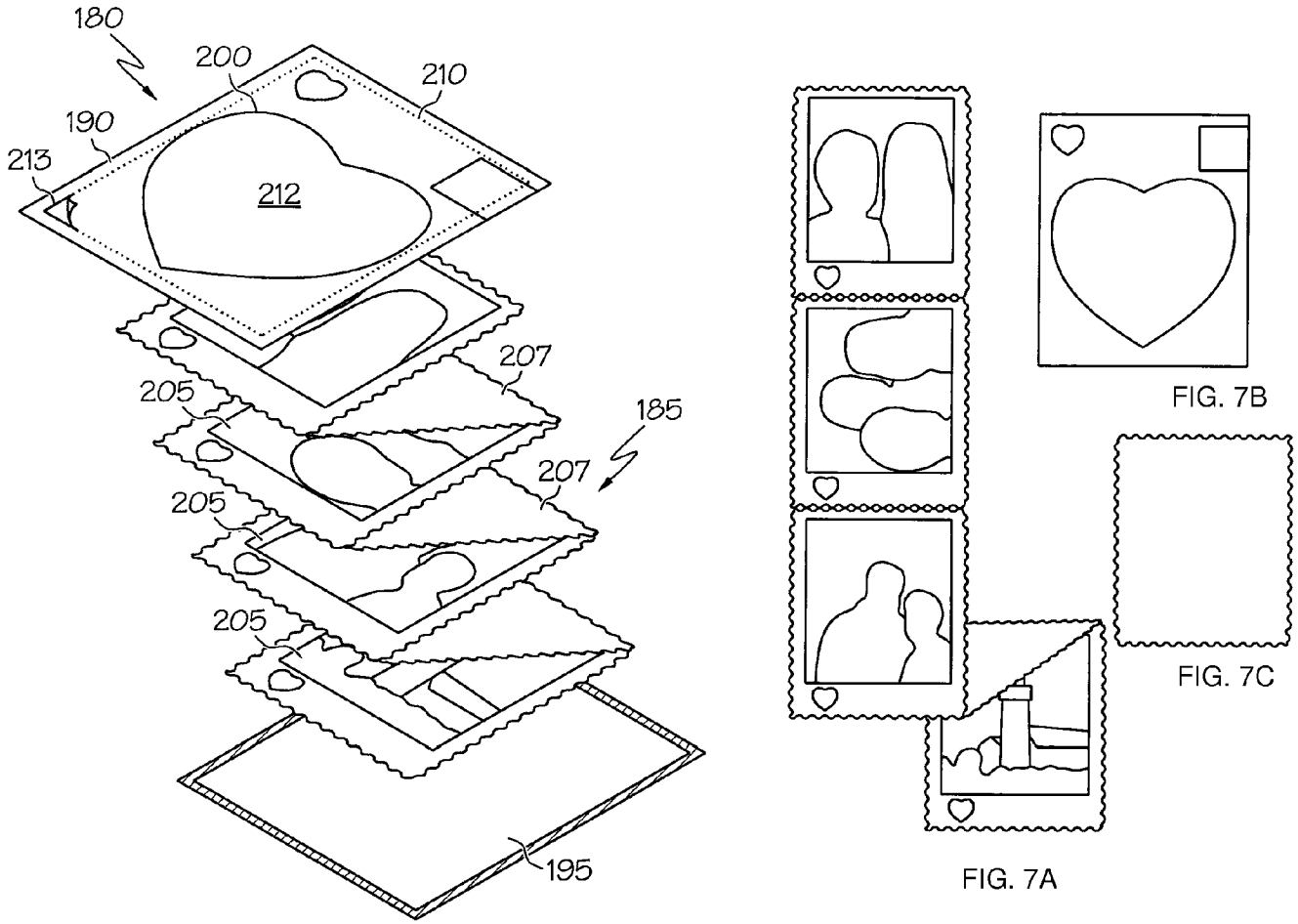
FIG. 7 illustrates a layered image assembly in accordance with an aspect of the present invention.
Figure 7E:
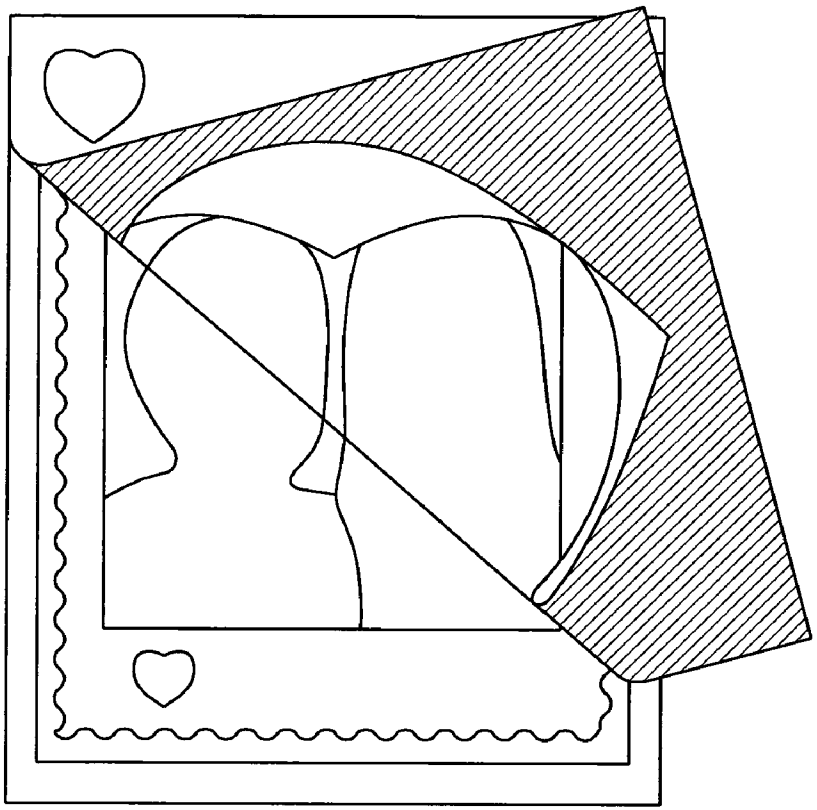
FIG. 7E illustrates the layered image assembly of FIG. 7 with the top layer being peeled away in accordance with an aspect of the present invention.
Figure 7D:
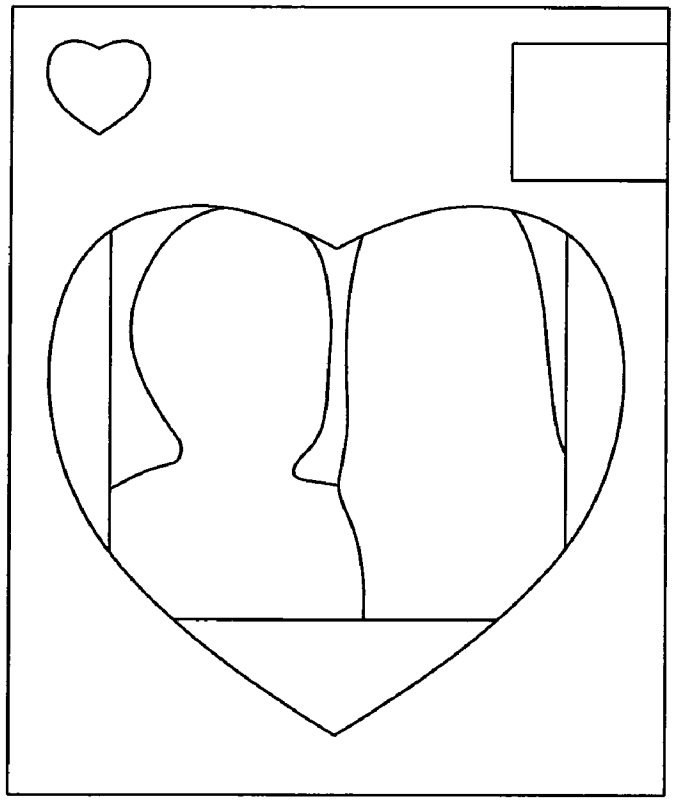
FIG. 7D illustrates the layered image assembly of FIG. 7 as assembled in accordance with an aspect of the present invention.

Turning now to FIG. 7, an example of a top protective layer 180 for use with a layered image assembly is shown in accordance with an aspect of the present invention. The top protective layer 180 can be manufactured from a material durable enough to survive shipping. Thus, the layered image assembly can be placed on an outside surface of a package or letter without fear of damage to the layers provided under the top protective layer 180. As shown in FIG. 7, the top protective layer 180 comprises a frame portion 190 and an inner portion 200. The top protective layer 180 is constructed from any suitable single material. Alternatively, the frame portion 190 can be constructed from a different material than the inner portion 200, if desired. For instance, the frame portion 190 can be of a stiff paper construction, such as a flexible cardboard and the inner portion 200 can be of a plastic material. It is to be appreciated that any suitable material(s) can be used for the frame portion and the inner portion. Both materials are preferably durable enough to survive standard shipping. The frame portion 190 of the top protective layer 180 can be affixed permanently on all sides to an adhesive layer. The inner portion 200 can be removed to reveal one or more layers onserted between the adhesive layer and the top protective layer 180.

A perforation 210 can be provided around an edge of the inner portion 200. The perforation 210 can be provided on just a portion of the inner portion edge or can be provided fully around the edge of the inner portion to facilitate ease of removal of the entire inner portion. Alternately or additionally, at least one corner of the inner portion 200 can be tabbed 213 or otherwise suitably configured to facilitate easy removal of the inner portion 200 from the frame portion 190. The tabbed portion 213 can be created during manufacturing of the perforation of during a separate manufacturing step, such as a separate die-cut operation. It is to be appreciated that any suitable operation for creating the tabbed portion 213 can be employed.

FIG. 7 also illustrates a z-fold image layer 185 provided between the top protective layer 180 and a base 195. The base 195 can include an image printed thereon and can also include an adhesive backing layer so that the base 195 can be secured to a suitable structure, such as an envelope, package, mailer, card, and the like. The z-fold image layer 185 can include images on both sides. For instance, the z-fold image layer 185 can include a plurality of photos provided on one side of the layer 205 and a branding label, for example, on a second side of the layer 207. Any other suitable images can be provide on one or both sides of the z-fold layer, such as bar code(s), invisible ink, holograms, and security coding. The top protective layer 180 can include a substantially transparent window portion 212 such that a corresponding portion of the top layer of the z-fold 185 can be seen through the top protective layer 180.

Figure 8:
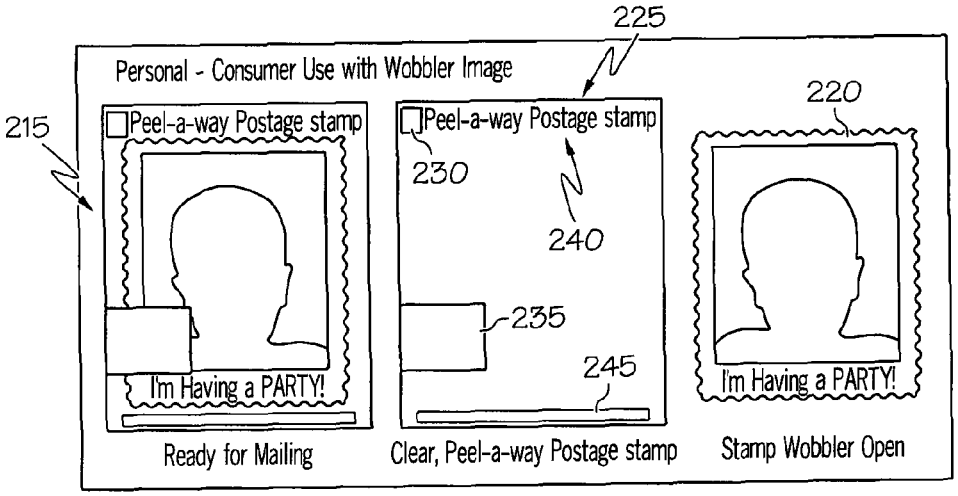
FIG. 8 illustrates a layered stamp assembly in accordance with an aspect of the present invention.
Figure 9:
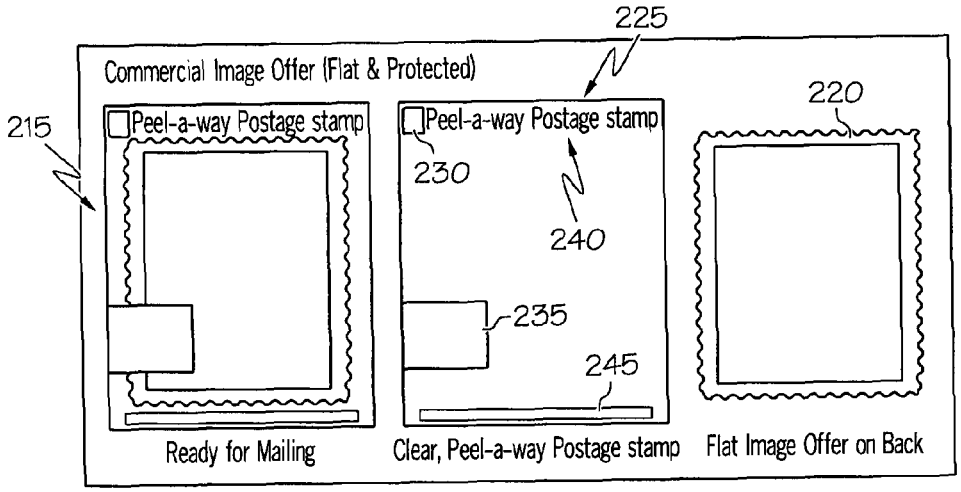
FIG. 9 illustrates a layered stamp assembly in accordance with an aspect of the present invention.

In accordance with one aspect of the invention, a layered image assembly can function as a postage stamp. A top protective layer serves as a prepaid postage stamp. The top protective layer can include indicia regarding the stamp denomination, the indicia being one of a number, a barcode, and/or any other suitable or required indicia. Security measures, such as one or more holograms, watermarks, official seals, and the like, can also be provided on this layer. FIGS. 8-11 illustrate examples of layered stamp assemblies in accordance with an aspect of the present invention. Turning to FIGS. 8 and 9, a layered stamp assembly 215 includes a first layer 220 having an image printed on at least one side of the first layer 220. It is to be appreciated that the first layer 220 can include images printed on both sides. The first layer 220 can also include a permanent, removable, or repositionable adhesive layer (not shown) on one or both sides of the first layer 220. A second layer 225 is provided over the first layer 220 and is substantially transparent such that the image provided on one side of the first layer 220 is seen through the second layer 225. The second layer 225 further includes postage stamp indicia 230, 235. Other indicia, such as security indicia (not shown), trademark indicia 240, removal instructions 245, and/or any other functional and/or decorative images (not shown) can be provided on the second layer 225. It is also to be appreciated that the second layer 225 can be semitransparent or opaque such that the full image of the first layer 220 is not seen through the second layer 225.

A sender can purchase the assembly 215 as a unit, for example, on a carrier sheet, or as individual components for do-it-yourself (DIY) assembly. The assembly 215 is positioned by the sender on a piece of mail like a conventional stamp. The first layer 220 is protected by the second layer 225 such that during the course of mail service, a conventional cancellation mark is provided on only the second layer 225. The receiver of the mail can then remove the second layer 225 to reveal the first layer 220, which is unmarked and undamaged by the shipping process. Thus, the first layer 220 can be removed from the mail and saved by the receiver, as desired.

Although not shown, the first layer 220 can be mounted on a spring assembly such that upon removal of the second layer 225, the first layer 220 can wobble in a clockwise and counterclockwise motion with respect to the mail or other surface on which the first layer 220 is mounted. Both sides of the spring assembly can include one of a permanent, removable, or repositionable adhesive layer thereon. Accordingly, the first layer 220 can be permanently or removably coupled to the mail. The spring assembly can be substantially similar to the spring assembly disclosed in co-pending U.S. patent application Ser. No. 11/551,945, the entirety of which is incorporated herein by reference. However, it is to be appreciated that any other suitable spring assembly can be employed and is contemplated as falling within the scope of the present invention. Alternatively, or additionally, the first layer 220 can be coupled to one or more of a magnet, suction cup, hook and loop fastener, snap, rivet, button, or any other suitable structure and/or method.

Figure 10:
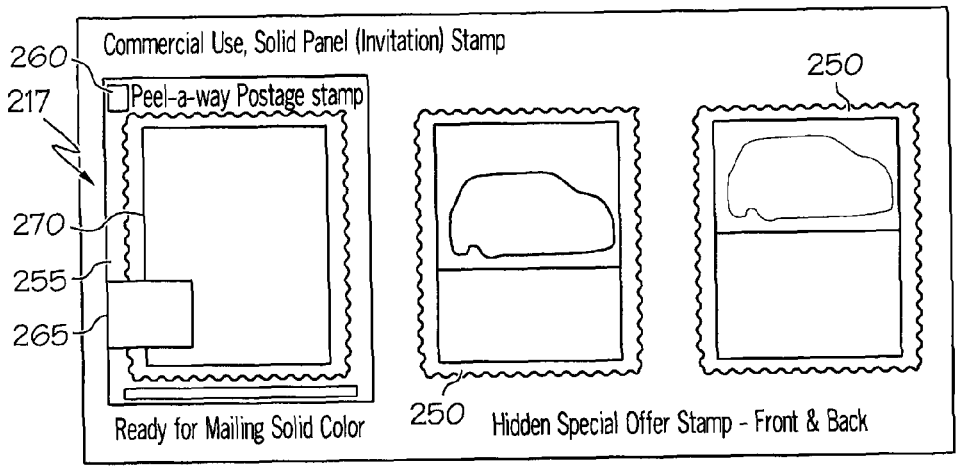
FIG. 10 illustrates a layered stamp assembly in accordance with an aspect of the present invention.

Turning to FIG. 10, another layered stamp assembly 247 is depicted in accordance with an aspect of the present invention. The assembly 247 includes a first layer 250 that can be printed on both the front side and back side as an advertisement, coupon offer, commemorative stamp, and/or the like. A second layer 255 is provided and functions as a postage stamp and includes required indicia 260, 265. Any other desired indicia can also be provided on the second layer 250. For instance the second layer 250 can includes an opaque portion 270 with an image to conceal the image(s) printed on the first layer 250. The opaque printed image 270 can be printed on a back side of the second layer 250 to protect the image 270 during shipping. Any desired number of layers can be provided between the mail and the second layer 255, which functions as a postage stamp. As above, during the normal course of mail service, a cancellation mark is provided over the second layer 255. A receiver of the mail can then remove the second layer 255 to reveal the unmarked and undamaged layer or layers underneath.

Figure 11:
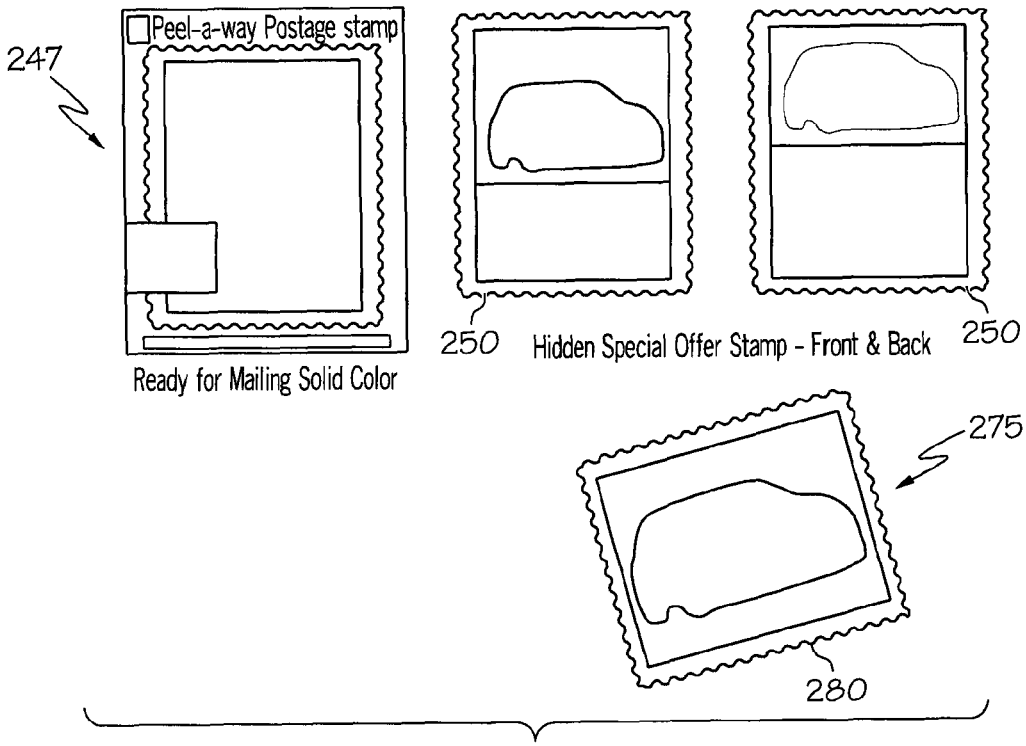
FIG. 11 illustrates a layered stamp assembly in accordance with an aspect of the present invention.

As shown in FIG. 11, one of the layers provided underneath the postage layer 255 can be the substantially flat advertisement or offer layer 250 and another layer 275 can include a wobble assembly 280. The wobble assembly 280 comprises a spring assembly (not shown), as described above, coupled to at least one image. Any number of flat, wobble, or other layers can be provided underneath the postage layer 255, as desired.

Figure 12:
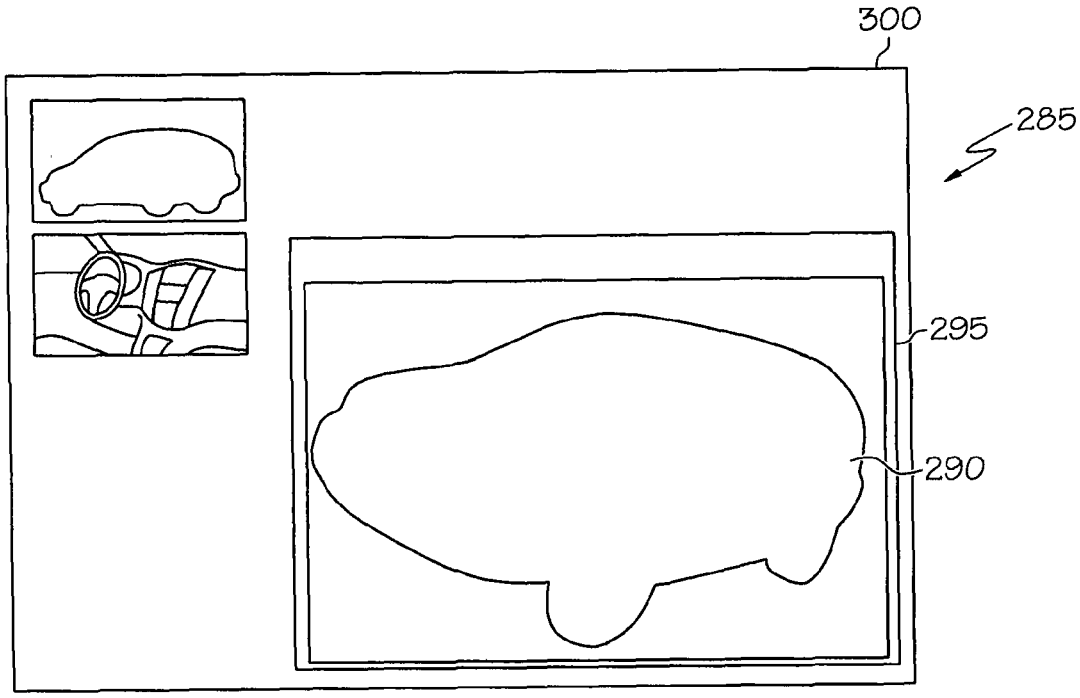
FIG. 12 illustrates a layered image assembly on a front of a postcard in accordance with an aspect of the present invention.

FIG. 12 illustrates another example of a layered assembly 285 in accordance with an aspect of the present invention. The layered assembly 285 includes a wobble assembly 290 having a removable layer 295 positioned over the wobble assembly 290 to flatten and/or protect the wobble assembly 290. The wobble assembly 290 includes a spring assembly (not shown) as described above and for example, in co-pending U.S. patent application Ser. No. 11/551,945. As shown herein, the spring assembly is coupled to a postcard 300. However, the spring assembly can be coupled to any desired item, such as shipping and mailing products, envelopes, advertisements, books, magazines, newspapers, greeting cards, packaging, food packaging (e.g., cups, wrappers and containers for burgers, fries, and the like, cereal boxes, etc.), clothing, appliances, computers, office equipment, furniture, vehicles, windows, mirrors, bulletins and wipe boards, or any other suitable material or structure. In the present example, the wobble assembly 290 is provided on a postcard 300 in which the removable layer 295 can be peeled off to reveal the wobble assembly 290, which can also be removable from the postcard 300, if desired. It is to be appreciated that the removable layer 295 can be transparent, semitransparent, or opaque. The removable layer 295 can also include one or more indicia, as desired. It is to be further appreciated that any number and type of layers (flat layers, wobble layers, etc.) can be provided underneath the removable layer 295.

Figure 13:
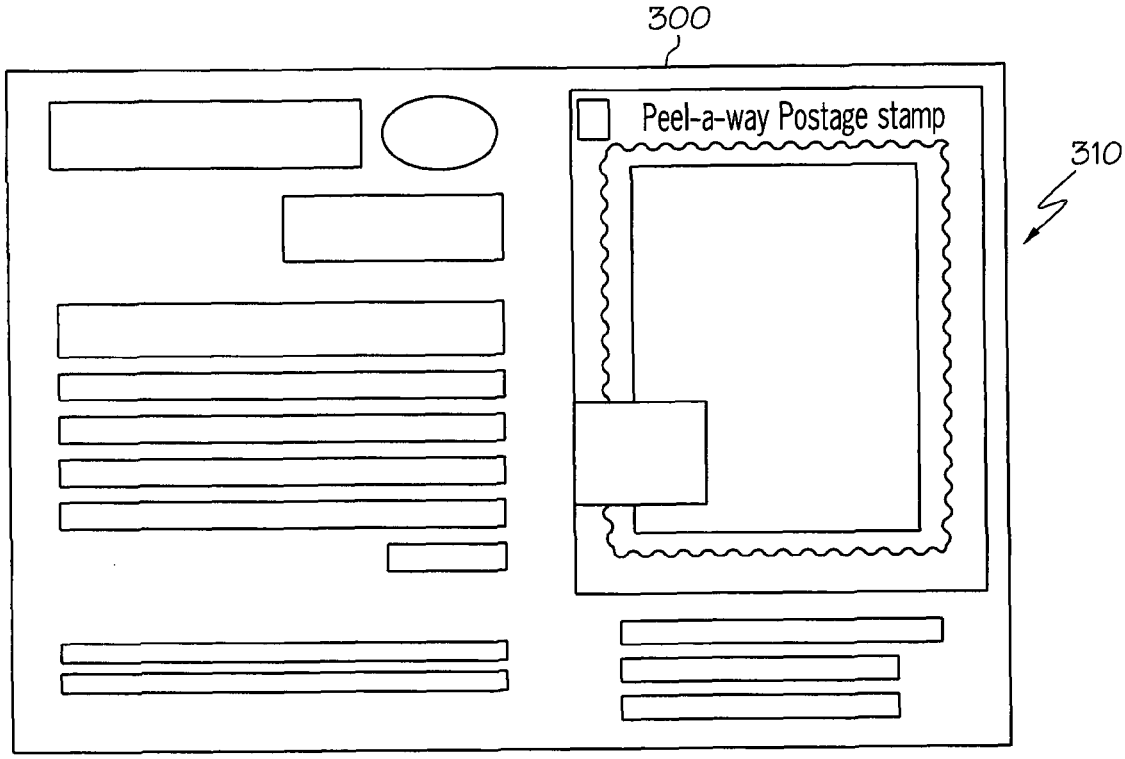
FIG. 13 illustrates a layered stamp assembly on a back of a postcard in accordance with an aspect of the present invention.

FIG. 13 illustrates a back side of the postcard 300. This side can include a layered stamp assembly 310. The layered stamp assembly 310 is as described above with respect to FIGS. 8-11. As shown, the layered stamp assembly 310 can be provided on one side of the postcard 300 with the address block and the layered wobble assembly 290 can be provided on an opposite side of the postcard 300. Alternatively or additionally, one side of the postcard 300 can include both types of layered image assemblies 290, 310.

Figure 14:
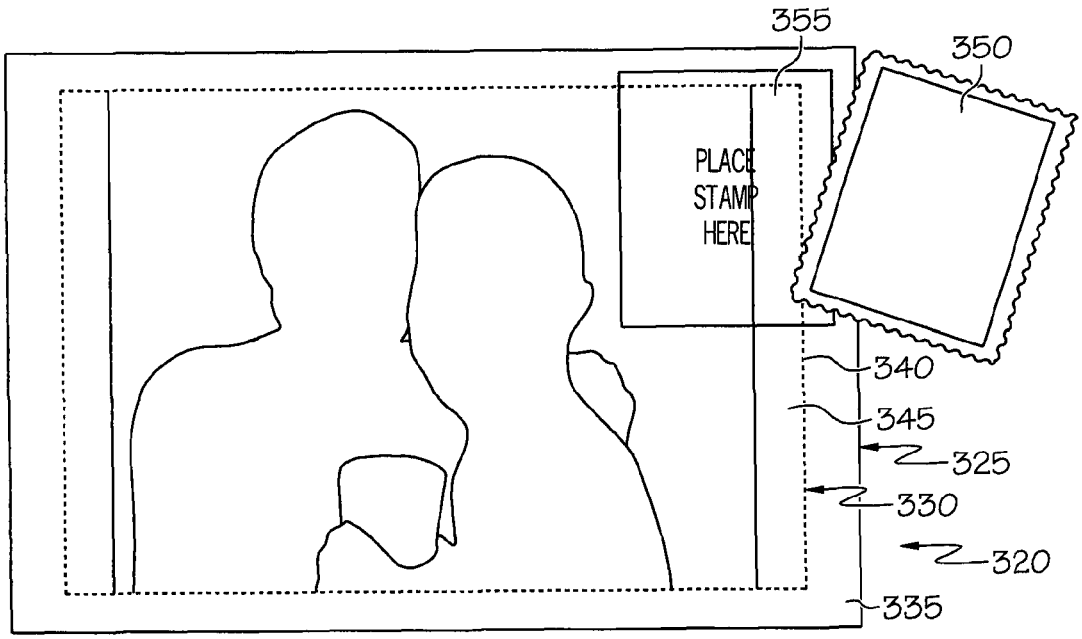
FIG. 14 illustrates a layered image assembly on a postcard in accordance with an aspect of the present invention.

FIG. 14 illustrates another example of a postcard 320 having a layered image assembly 325. The layered image assembly 325 is of substantially the same size as the postcard 320 itself. The layered image assembly 325 includes an image layer 330 having a photo thereon. The image layer 300 can be positioned over a spring assembly, an adhesive layer (permanent, removable, or repositionable), or over another image layer. A top protective layer 335 is positioned over the image layer 330. The top protective layer 335 can include a perforation 340 such that a user is able to peel away an inner portion 345 of the top protective layer 335. When the inner portion 345 is peeled away, the user can remove the photo from the postcard 320. Alternatively, the photo image layer 330 can remain on the postcard 320 and the outer portion of the top protective layer 335 can act as a frame. Thus, the postcard 320 becomes a keepsake framed photo. For mailing, a postage stamp 350 can be positioned in an upper corner portion of the top protective layer 335. When the inner portion 345 is removed, the stamp 350 can be removed with it.

Figure 15:
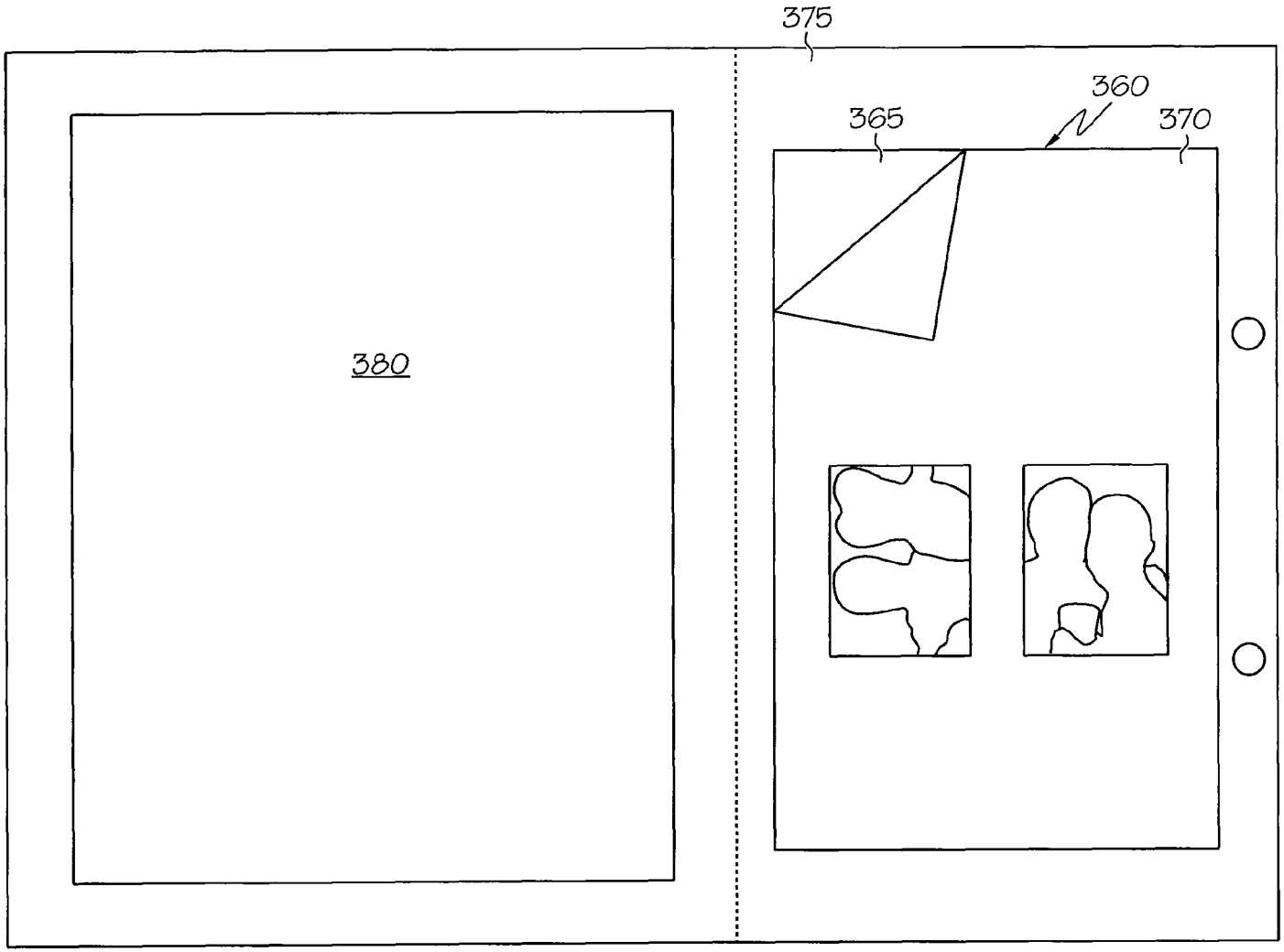
FIG. 15 illustrates a card having a layered image assembly in accordance with an aspect of the present invention.
Figure 15A:
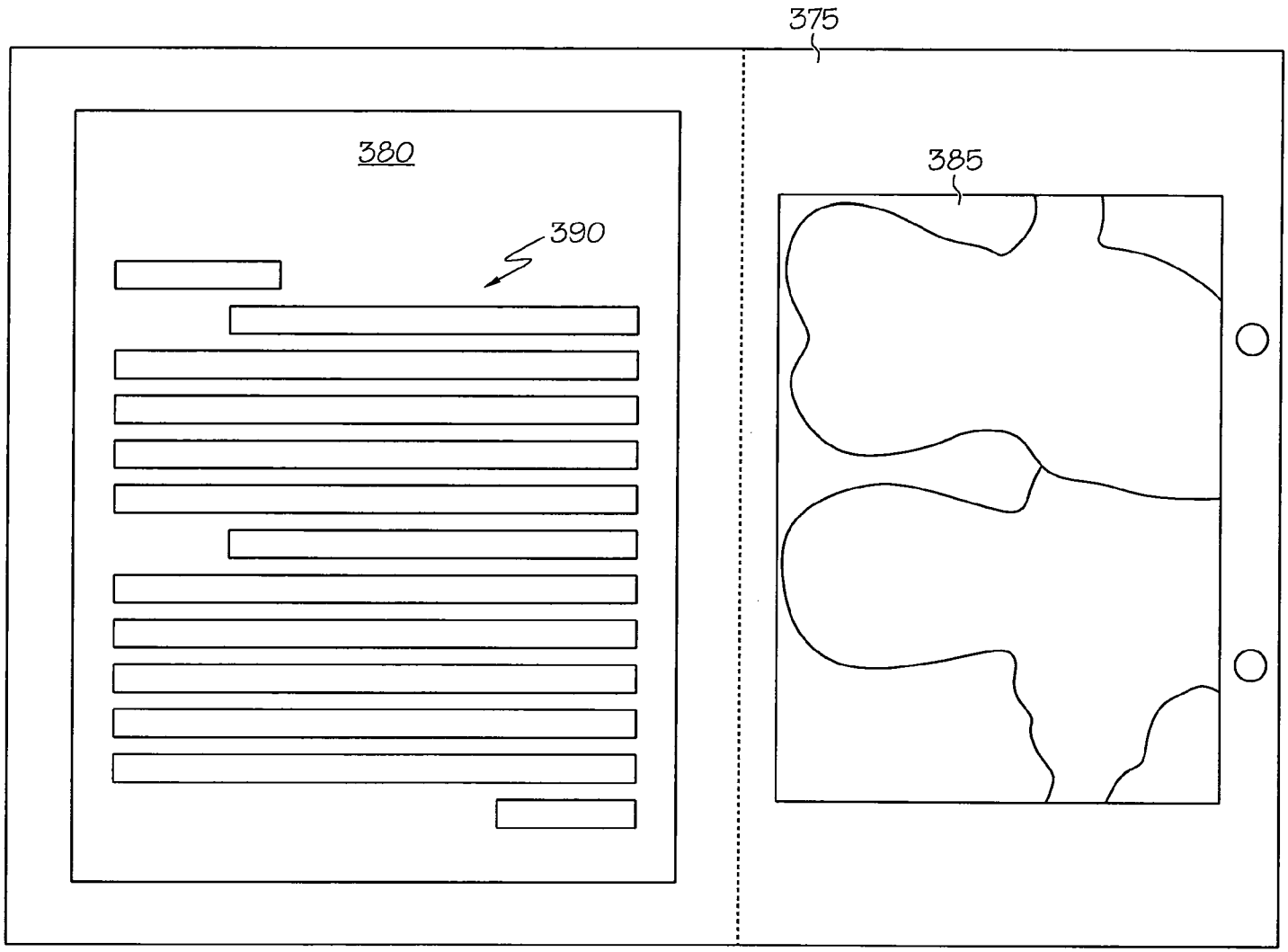
FIG. 15*a* illustrates the card of FIG. 15 in accordance with another aspect of the present invention
Figure 16:
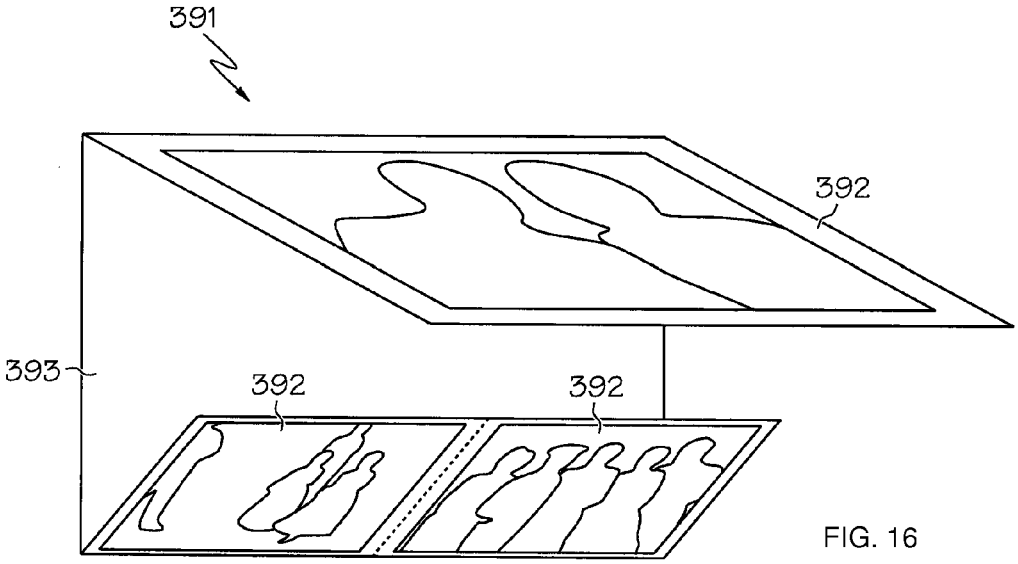
FIG. 16 illustrates a greeting card in accordance with another aspect of the present invention.
Figure 16A:
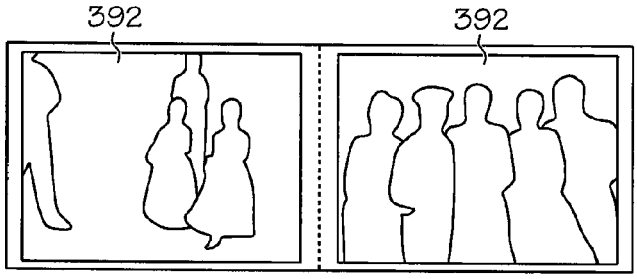
FIG. 16A illustrates a first side of a component of the layered image assembly of FIG. 16 in accordance with an aspect of the present invention.
Figure 16B:
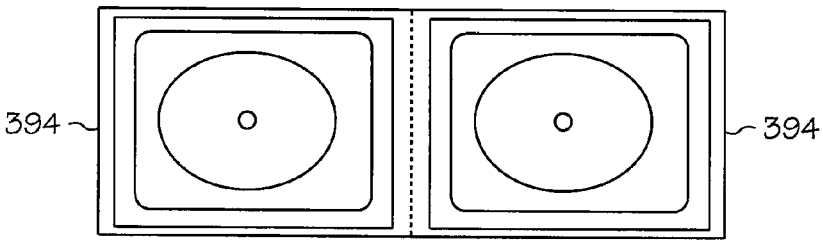
FIG. 16B illustrates a second side of a component of the layered image assembly of FIG. 16 in accordance with an aspect of the present invention.

FIGS. 15 and 15*a* illustrate another use of a layered image assembly 360 in accordance with an aspect of the present invention. The layered image assembly 360 can include an adhesive layer 365 and an image layer 370. The adhesive layer 365 is applied to a base, such as a postcard, greeting card, or the like 375. The image layer 370 is provided over the adhesive layer 365 and is of a material so as to be removable from the adhesive layer 365 while leaving a stick tacky surface. Thus, the image layer 370 acts as a peel away protective liner. Text is provided on the image layer 370 with instructions on how to use the layered image assembly 360. A buyer of the card 375 can peel away the image layer 370, leaving the sticky adhesive layer 365 behind. As shown in FIG. 16, the buyer can then place a personalized image such as a photo 385 on top of the adhesive layer 365. An empty space 380 can be provided on the card 375 so that the buyer can write a message 390 to the recipient of the card 375. Additionally or alternatively, a preprinted message and/or image can be provided in this space 380. The card 375 is also configured such that the user can tear away the photo or image portion from the text portion to keep the image portion as a keepsake item. The image portion can include a spring assembly on the back side such that the user can use the image portion as a wobble item.

FIG. 16 illustrates a greeting card 391 having a plurality of image portions 392 that can be separated from a text portion 393 of the greeting card 391. Spring assemblies 394 can be attached to a backside of the image portions 392, if desired.

Figure 17:
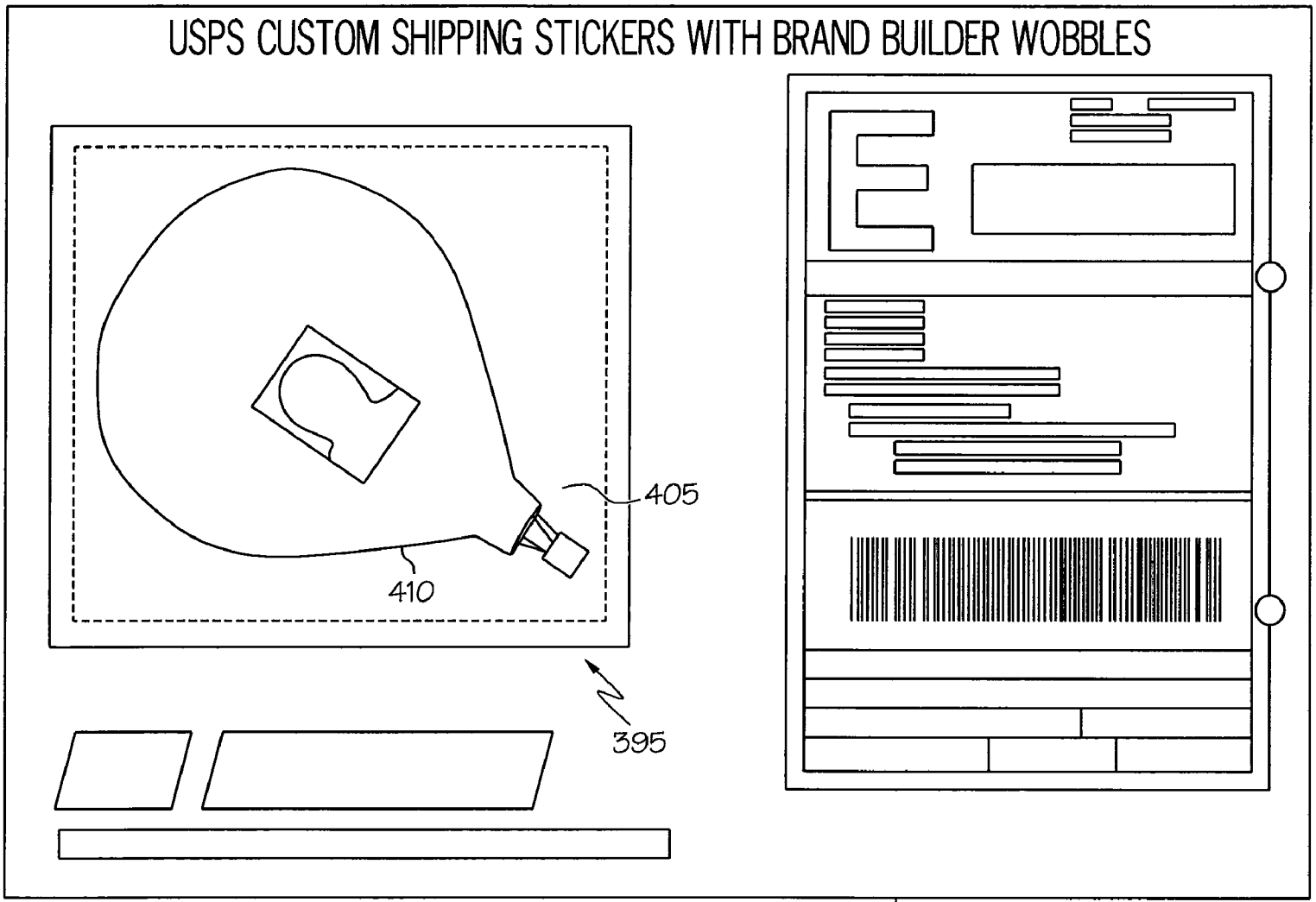
FIG. 17 illustrates a shipping label with a layered image assembly in accordance with an aspect of the present invention.
Figure 18:
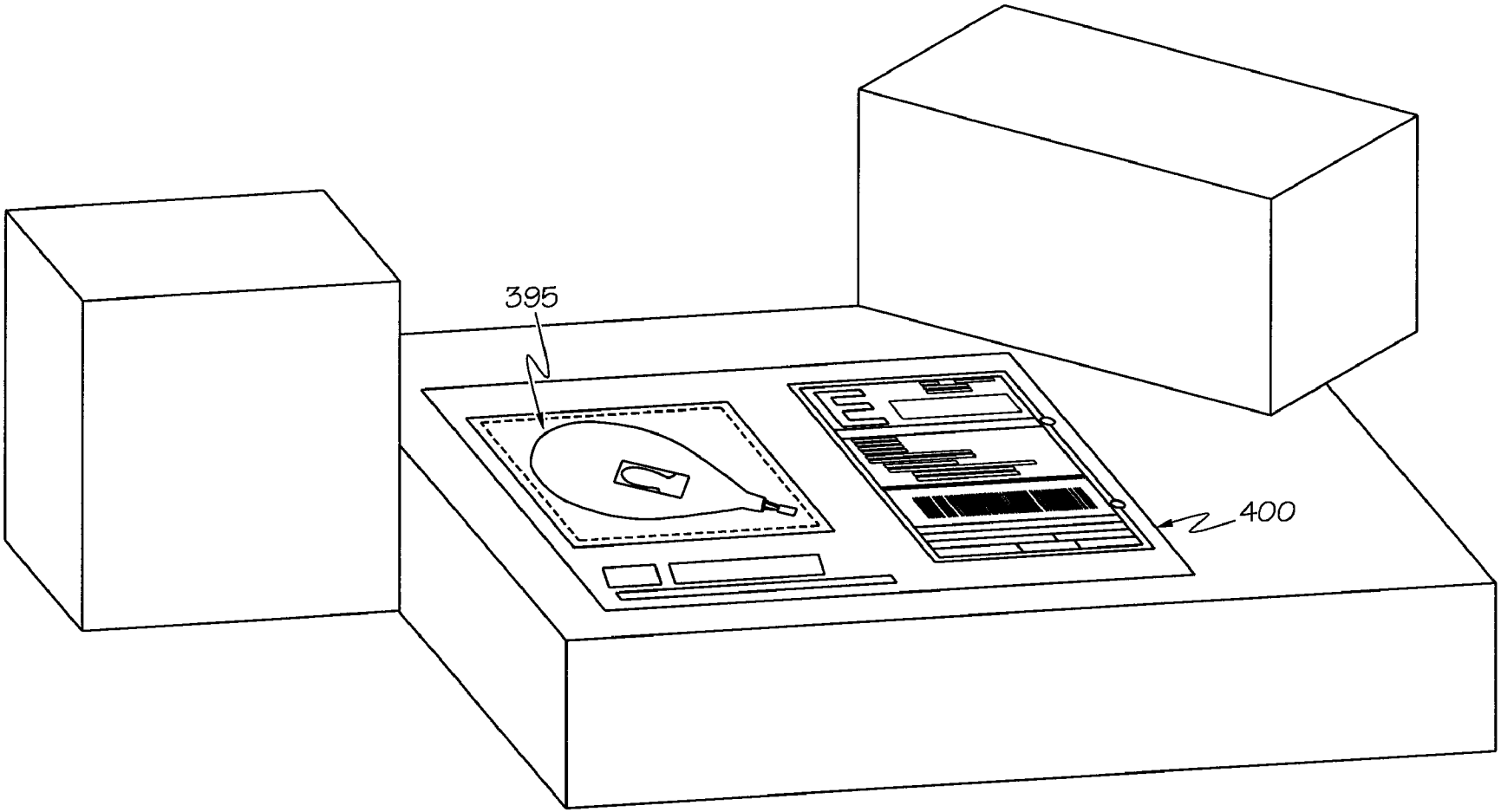
FIG. 18 illustrates the shipping label of FIG. 17 on packaging in accordance with an aspect of the present invention.

FIGS. 17 and 18 illustrate yet another use of a layered image assembly 395 in accordance with an aspect of the present invention. The layered image assembly 395 can be used on shipping labels and packaging 400 for personalization and/or marketing purposes. A recipient of a package can remove a top protective layer 405 of the layered image assembly 395 to reveal a wobble assembly 410 that can be placed on the recipient's refrigerator, for example. Instead of or in additional to a wobble assembly, any other suitable item or items, such as a magnet, coupon, brochure, business card, photo, etc. can be provided under the top protective layer 405. The top protective layer 405 is of a material to protect the layer or layers underneath from damage during shipping.

Figure 19:
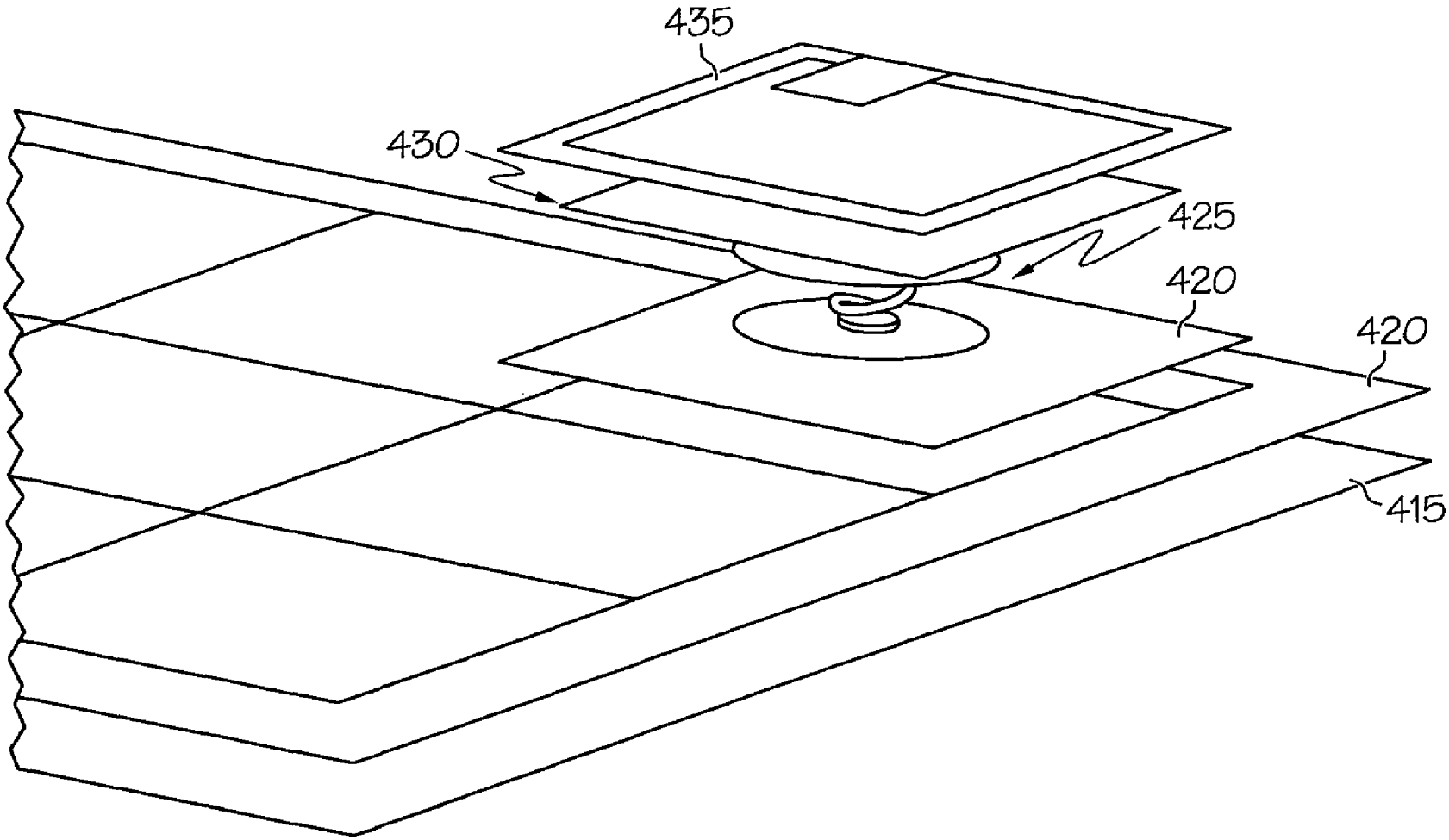
FIG. 19 illustrates a carrier sheeting having a plurality of layered image assemblies thereon in accordance with an aspect of the present invention.

FIG. 19 depicts a support structure 415 used during manufacturing of a plurality of layered image assemblies. The support structure 415 can be a carrier sheet or a carrier roll and is used to carry the layered image assemblies and/or to transfer the layered image assemblies to another structure. A base layer 420 is provided over the carrier sheet or roll 415 and can optionally include an adhesive backing, such as a permanent, removable, or repositionable adhesive layer. The base layer 420 can include printing thereon and can be precut for removal of the individual layered assemblies. An optional spring assembly 425 can be coupled to the base layer 420. The spring assembly 425 is configured to be fully collapsible such that the coils of the spring are received within an aperture and lie generally along a single plane. One or both sides of the spring assembly 425 can be provided with a desired adhesive layer (e.g., permanent, removable, or repositionable). One or more optional image layers 430 can be provided over one the spring assembly 425. The image layer(s) 430 can include any desired image (e.g., text, graphics, photographs, etc.) or object and can be printed, inserted, and/or produced using any suitable production method. A top protective layer 435 is then place over the image layer(s) 430. The optional spring assembly 425 and image layer(s) 430 are inserted or onserted between a solid edge frame of the top protective layer 435. The top protective layer 435 can be a clear or opaque film layer of any shape and size. The top protective layer 435 can also include printing on one or both sides of the layer. For instance, the top protective layer 435 can be a US postage stamp layer.

Although not fully shown herein, any or all of the removable layers can include a tabbed portion for easy removal of the layer. The tabbed portion can be of any suitable size and structure to facilitate such removal. While the images shown herein have included postage stamp shaped images and rectangular images with sharp corners, it is to be appreciated that any of the layers discussed and presented herein can be of any suitable shape and size. For instance the postage stamp layer can include rounded corners to mitigate sharp edges. It is also to be appreciated that although the protective layer has been referred to herein as a top protective layer, any other suitable layer(s) can be positioned on top of the protective layer. In other words, the top protective layer does not necessarily mean the topmost layer of the image assembly.

What has been described above includes example implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations of the present invention.

It should be evident that this disclosure is by way of example and that various changes may be made by adding, modifying or eliminating details without departing from the scope of the teaching contained in this disclosure. The invention is therefore not limited to particular details of this disclosure except to the extent that the following claims are necessarily so limited.

The invention claimed is:

1. A layered assembly comprising:

a base layer;

a protective top layer provided over the base layer;

a first adhesive layer provided between the base layer and the protective top layer, the first adhesive layer being provided around a periphery portion of the protective top layer so as to affix the periphery portion of the protective top layer to the base layer;

a substantially transparent layer provided over the protective top layer and extending across the protective top layer; and a first image layer onserted between the base layer and the protective top layer, wherein the protective top layer is provided over the first image layer and at least a portion of the protective top layer can be removed to reveal the first image layer, and wherein the protective top layer includes a perforation extending entirely around an inner edge of the periphery portion of the protective top layer so as to allow removal of an entire inner portion of the protective top layer; and a lift tab provided on the inner portion of the protective top layer, wherein the lift tab does not extend beyond the inner portion, and wherein the inner portion has a geometry that defines at least one corner, the lift tab being located at the at least one corner, and wherein the substantially transparent layer also includes the perforation such that removal of the inner portion of the protective top layer also removes the corresponding substantially transparent layer provided over the inner portion of the protective top layer.

2. The layered assembly of claim 1, wherein the protective top layer is a postage stamp.

3. The layered assembly of claim 2, wherein the protective top layer includes stamp denomination indicia.

4. The layered assembly of claim 3, wherein the stamp denomination indicia includes at least one of a number and a barcode.

5. The layered assembly of claim 2, wherein the protective top layer includes at least one security mark.

6. The layered assembly of claim 1, further comprising a second adhesive layer coupled to the protective top layer, wherein the second adhesive layer is a removable adhesive layer.

7. The layered assembly of claim 1, wherein the adhesive layer is a permanent adhesive layer.

8. The layered assembly of claim 1, wherein the protective top layer has an image printed thereon.

9. The layered assembly of claim 8 wherein the image printed on the protective top layer is printed to a side of the protective top layer adjacent the image layer to protect the image from environmental damage.

10. The layered assembly of claim 1, wherein the protective top layer is partially transparent and partially opaque.

11. The layered assembly of claim 1, further comprising a spring assembly coupled to the image layer.

12. The layered assembly of claim 1, wherein the first image layer comprises first and second sides, both sides having images printed thereon.

13. The layered assembly of claim 1, further comprising a second image layer coupled to the first image layer.

14. The layered assembly of claim 1, wherein the first image layer is one of a photograph, coupon, advertisement, booklet, and a marketing image.

15. The layered assembly of claim 1, further comprising a carrier sheet upon which the base can be mounted.

16. The layered assembly of claim 1, further comprising a carrier roll upon which the base can be mounted.

17. The layered assembly of claim 1, wherein the base is one of a package, book, magazine, newspaper, food packaging, postcard, greeting card, and envelope.

18. The layered assembly of claim 1, wherein the first image layer includes a bar code image.

19. The layered assembly of claim 1, wherein the first image layer is a coupon.

20. The layered assembly of claim 1, wherein the first image layer includes at least one of invisible ink, a security code, and a hologram thereon.

21. The layered assembly of claim 1, wherein the top protective layer includes at least of invisible ink, a security code, and a hologram thereon.

22. A layered assembly comprising:

a base layer;

an adhesive layer;

at least one image layer;

at least one protective top layer, wherein the at least one protective top layer includes a frame portion and an inner portion, the frame portion extending around an entire periphery of the inner portion, a substantially transparent layer provided over the protective top layer and extending across the protective top layer; and a lift tab provided on the inner portion of the protective top layer, wherein the lift tab does not extend beyond the inner portion, wherein the adhesive layer comprises a permanent adhesive applied to the frame portion of the at least one protective top layer so as to permanently affix the frame portion of the at least one protective top layer to the base layer such that removal of the lift tab does not disturb the frame portion of the at least one protective top layer, wherein the at least one protective top layer includes a perforation and is configured such that the inner portion of the protective top layer can be removed along the perforation, and wherein the inner portion has a geometry that defines at least one corner, the lift tab being located at the at least one corner, and wherein the substantially transparent layer also includes the perforation such that removal of the inner portion of the protective top layer also removes the corresponding substantially transparent layer provided over the inner portion of the protective top layer.

23. The layered assembly of claim 22, further comprising a plurality of adhesive layers.

24. The layered assembly of claim 22, further comprising a plurality of image layers, wherein one image layer is attached to another image layer by a perforated edge.

25. The layered assembly of claim 24, wherein the plurality of image layers are arranged in a z-fold configuration.

26. The layered assembly of claim 22, wherein the perforation is interrupted by the lift tab.

27. The layered assembly of claim 22, wherein the lift tab includes a generally curved geometry.

28. The layered assembly of claim 22, wherein the lift tab is formed by a manufacturing operation other than perforation.

29. The layered assembly of claim 22, wherein the inner portion can be completely removed from the remainder of the protective top layer along the perforation.

30. The layered assembly of claim 22, wherein at least one image is printed on both sides of the image layer.

31. The layered assembly of claim 22, further comprising a spring assembly coupled to the at least one image layer.

32. The layered assembly of claim 22, wherein the at least one protective top layer includes a rigid frame portion and a perforated flexible inner portion.

33. The layered assembly of claim 22, wherein the at least one protective top layer is printed on one side.

34. The layered assembly of claim 33, wherein the at least one protective top layer is printed with postage stamp indicia.

35. The layered assembly of claim 34, wherein the at least one protective top layer includes a perforation and is configured such that an inner portion of the protective top layer can be at least partially removed along the perforation, at least a portion of the perforation extending through the postage stamp indicia such that removal along the perforation causes irreparable damage to the postage stamp indicia.

36. The layered assembly of claim 33, wherein the at least one protective top layer is printed on the side adjacent the at least one of the image layer.

37. The layered assembly of claim 22, wherein the at least one protective top layer is of a material durable enough to withstand standard shipping.

* * * * *

UNITED STATES PATENT AND TRADEMARK OFFICE

CERTIFICATE OF CORRECTION

PATENT NO. : 8,196,324 B2
APPLICATION NO. : 11/834898
DATED : June 12, 2012
INVENTOR(S) : John C. Sullivan, Jeffrey Stanley Samson and Robert F. Morton It is certified that error appears in the above-identified patent and that said Letters Patent is hereby corrected as shown below:

In Claim 21 at Col. 10, Line 58, insert the word --one-- after the word "least".

Signed and Sealed this
Thirty-first Day of July, 2012

David J. Kappos

David J. Kappos
*Director of the United States Patent and Trademark Office*